US010136710B2

(12) United States Patent
Roberts et al.

(10) Patent No.: US 10,136,710 B2
(45) Date of Patent: Nov. 27, 2018

(54) CRANKLESS CANTILEVERED UMBRELLA

(71) Applicant: SOL UMBRA, LLC, Ann Arbor, MI (US)

(72) Inventors: Thomas Roberts, Elk Grove, CA (US); Gary Ricco, Reno, NV (US)

(73) Assignee: SOL UMBRA, LLC, Ann Arbor, MI (US)

( * ) Notice: Subject to any disclaimer, the term of this patent is extended or adjusted under 35 U.S.C. 154(b) by 0 days.

(21) Appl. No.: 15/666,084

(22) Filed: Aug. 1, 2017

(65) Prior Publication Data

US 2018/0030751 A1 Feb. 1, 2018

Related U.S. Application Data

(60) Provisional application No. 62/369,391, filed on Aug. 1, 2016, provisional application No. 62/383,704, filed on Sep. 6, 2016.

(51) Int. Cl.

| | |
|---|---|
| ***A45B 23/00*** | (2006.01) |
| ***E04H 15/28*** | (2006.01) |
| ***E04H 15/60*** | (2006.01) |
| ***A45B 25/14*** | (2006.01) |

(52) U.S. Cl.

CPC ..... *A45B 23/00* (2013.01); *A45B 25/14* (2013.01); *E04H 15/28* (2013.01); *E04H 15/60* (2013.01); *A45B 2023/0037* (2013.01)

(58) Field of Classification Search

CPC ..... A45B 23/00; A45B 2023/0037; A45B 2023/005; E04H 15/28

See application file for complete search history.

(56) References Cited

U.S. PATENT DOCUMENTS

| | | | | |
|---|---|---|---|---|
| 4,606,366 | A | 8/1986 | Collet | |
| 4,807,655 | A | 2/1989 | Robertson | |
| 5,655,557 | A | 8/1997 | Martin | |
| 5,785,069 | A * | 7/1998 | Glatz | A45B 23/00 135/20.1 |

(Continued)

FOREIGN PATENT DOCUMENTS

| | | | |
|---|---|---|---|
| DE | 20014895 | U1 | 11/2000 |
| EP | 1097652 | B1 | 1/2004 |

OTHER PUBLICATIONS

International Search Report dated Oct. 9, 2017 in PCT/US2017/044915.

*Primary Examiner* — Noah Chandler Hawk

(74) *Attorney, Agent, or Firm* — Young Basile Hanlon & MacFarlane, P.C.

(57) ABSTRACT

A cantilevered umbrella comprising a mast having an elongated configuration, a cantilevered arm extending from the mast, a canopy extending from the cantilevered arm, a carriage connected to the cantilevered arm, and at least one of a constant force spring or a gas spring connected to the mast. The carriage is vertically moveable along the mast to move the canopy between an open position, wherein the canopy is extended, and a collapsed position, wherein the canopy is collapsed. The at least one of the constant force spring or the gas spring is operable with the carriage to assist with moving the canopy between the open position and the collapsed position and to counterbalance the weight of the cantilevered arm and the canopy.

11 Claims, 10 Drawing Sheets

(56) References Cited

U.S. PATENT DOCUMENTS

| | | | | |
|---|---|---|---|---|
| 5,937,882 | A * | 8/1999 | Harbaugh | A45B 23/00 135/20.3 |
| 5,960,806 | A * | 10/1999 | Steiner | A45B 23/00 135/20.1 |
| 6,129,101 | A | 10/2000 | Dubinsky | |
| 6,196,242 | B1 * | 3/2001 | Xu | A45B 23/00 135/20.1 |
| 6,588,438 | B1 * | 7/2003 | Steiner | A45B 23/00 135/20.1 |
| 6,923,193 | B2 * | 8/2005 | Chen | A45B 23/00 135/20.1 |
| 7,156,114 | B2 * | 1/2007 | Lo | A45B 23/00 135/20.1 |
| 7,520,289 | B1 | 4/2009 | Barber | |
| 8,104,492 | B2 | 1/2012 | Dan | |
| 2014/0116481 | A1 | 5/2014 | Ma | |
| 2015/0351505 | A1 | 12/2015 | Ostrander | |
| 2016/0113364 | A1 * | 4/2016 | Ostrander | A45B 23/00 135/20.1 |

* cited by examiner

CRANKLESS CANTILEVERED UMBRELLA

CROSS-REFERENCE TO RELATED APPLICATION

This application claims the benefit of U.S. Provisional Application Ser. No. 62/369,391, filed on Aug. 1, 2016, and U.S. Provisional Application Ser. No. 62/383,704, filed on Sep. 6, 2016, the entire disclosures of which are incorporated herein by reference.

TECHNICAL FIELD

This disclosure relates generally to cantilevered umbrellas, and more particularly, crankless cantilevered umbrellas.

BACKGROUND

Cantilevered umbrellas provide shade from the sun. Traditional cantilevered umbrellas have a dome-shaped canopy that is suspended from a cantilevered arm. The canopy is typically opened using a crank mechanism. Because of this, traditional cantilevered umbrellas can be cumbersome to operate and position to ensure that the shade provided is maximized.

SUMMARY

Cantilevered umbrellas are disclosed herein. In a first embodiment, the cantilevered umbrella includes a mast having an elongated configuration, a cantilevered arm extending from the mast, a canopy extending from the cantilevered arm, a carriage connected to the cantilevered arm, and at least one of a constant force spring or a gas spring connected to the mast. The canopy is moveable between an open position, wherein the canopy is extended, and a collapsed position, wherein the canopy is collapsed. The carriage is vertically moveable along the mast (30) to move the canopy (60) between the open position and the collapsed position. The at least one of the constant force spring or the gas spring is operable with the carriage to assist with moving the canopy between the open position and the collapsed position and to counterbalance the weight of the cantilevered arm and canopy.

The at least one of the constant force spring or the gas spring can be disposed within an internal cavity of the mast. The carriage can be disposed within the internal cavity of the mast. The cantilevered umbrella can include a rail extending substantially vertically along an outer surface of the mast and a guide connected to the rail and the carriage. The carriage can rise within the internal cavity of the mast as the guide is raised along the rail, and the carriage can lower within the internal cavity of the mast as the guide is lowered along the rail. The at least one of the constant force spring or the gas spring can be connected to the mast within the internal cavity at a point that is closer to the upper end of the mast than a base. The at least one of the constant force spring or the gas spring can uncoil or extend as the carriage is lowered within the internal cavity of the mast and recoil or retract as the carriage is raised within the internal cavity of the mast. The cantilevered umbrella can include a support arm having a first end pivotally connected to the mast and a second end connected to the cantilevered arm. The cantilevered umbrella can include an over-center assembly disposed within the internal cavity of the mast and engageable with the carriage to hold the canopy in the open position.

In a second embodiment, the cantilevered umbrella includes a mast extending substantially vertical, a cantilevered arm extending from the mast, a canopy extending from the cantilevered arm, a carriage connected to the cantilevered arm, at least one of a constant force spring or a gas spring connected to the mast, and an over-center spring assembly disposed with an internal cavity of the mast. The carriage is vertically movable along the mast to move the canopy between an open position, wherein the canopy is extended, and a collapsed position, wherein the canopy is collapsed. The at least one of the constant force spring or the gas spring is operable with the carriage to assist with moving the canopy between the open position and the collapsed position and to counterbalance the weight of the cantilevered arm and the canopy. The over-center spring assembly has a gas spring and a forked lever arm. The forked lever arm is pivotally connected to the gas spring and engages a roller of the carriage when the canopy is in the open position.

A recess of the forked lever arm can engage the roller of the carriage when the canopy is in the open position. The forked lever arm can be moveable between a first position, where the recess of the forked lever arm is angled downward, and a second position, where the recess of the forked lever arm is angled upward. The at least one of the constant force spring or the gas spring can uncoil or extend as the carriage is lowered within the internal cavity of the mast and recoil or retract as the carriage is raised within the internal cavity of the mast.

In a third embodiment, the cantilevered umbrella includes a mast having an internal cavity, a cantilevered arm extending from the mast, a canopy extending from the cantilevered arm, a carriage connected to the cantilevered arm, and an over-center spring assembly disposed within an internal cavity of the mast. The canopy is moveable between an open position, wherein the canopy is extended, and a collapsed position, wherein the canopy is collapsed. The carriage is vertically moveable along the mast to move the canopy between the open position and the collapsed position. The over-center spring assembly is engageable with the carriage to hold the canopy in the open position.

The over-center spring assembly can include a gas spring disposed within the internal cavity of the mast and a forked lever arm pivotally connected to the gas spring. The forked lever arm can engage a roller of the carriage when the canopy is in the open position. A recess of the forked lever arm can engage the roller of the carriage when the canopy is in the open position. The forked lever arm can be moveable between a first position, where the recess of the forked lever arm is angled downward, and a second position, where the recess of the forked lever arm is angled upward.

The cantilevered umbrella can include a rail extending substantially vertically along an outer surface of the mast and a guide connected to the rail and the carriage. The carriage can raise within the internal cavity of the mast as the guide is raised along the rail and the carriage can lower within the internal cavity of the mast as the guide is lowered along the rail. The cantilevered umbrella can include at least one of a constant force spring or a gas spring disposed within the internal cavity of the mast and operable with the carriage to assist with moving the canopy between the open position and the collapsed position. The at least one of the constant force spring or the gas spring can be connected to the mast within the internal cavity at a point that is closer to an upper end of the mast than a base. The at least one of the constant force spring or the gas spring can uncoil or extend as the carriage is lowered within the internal cavity of the mast and recoil or retract as the carriage is lowered within the internal cavity of the mast.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
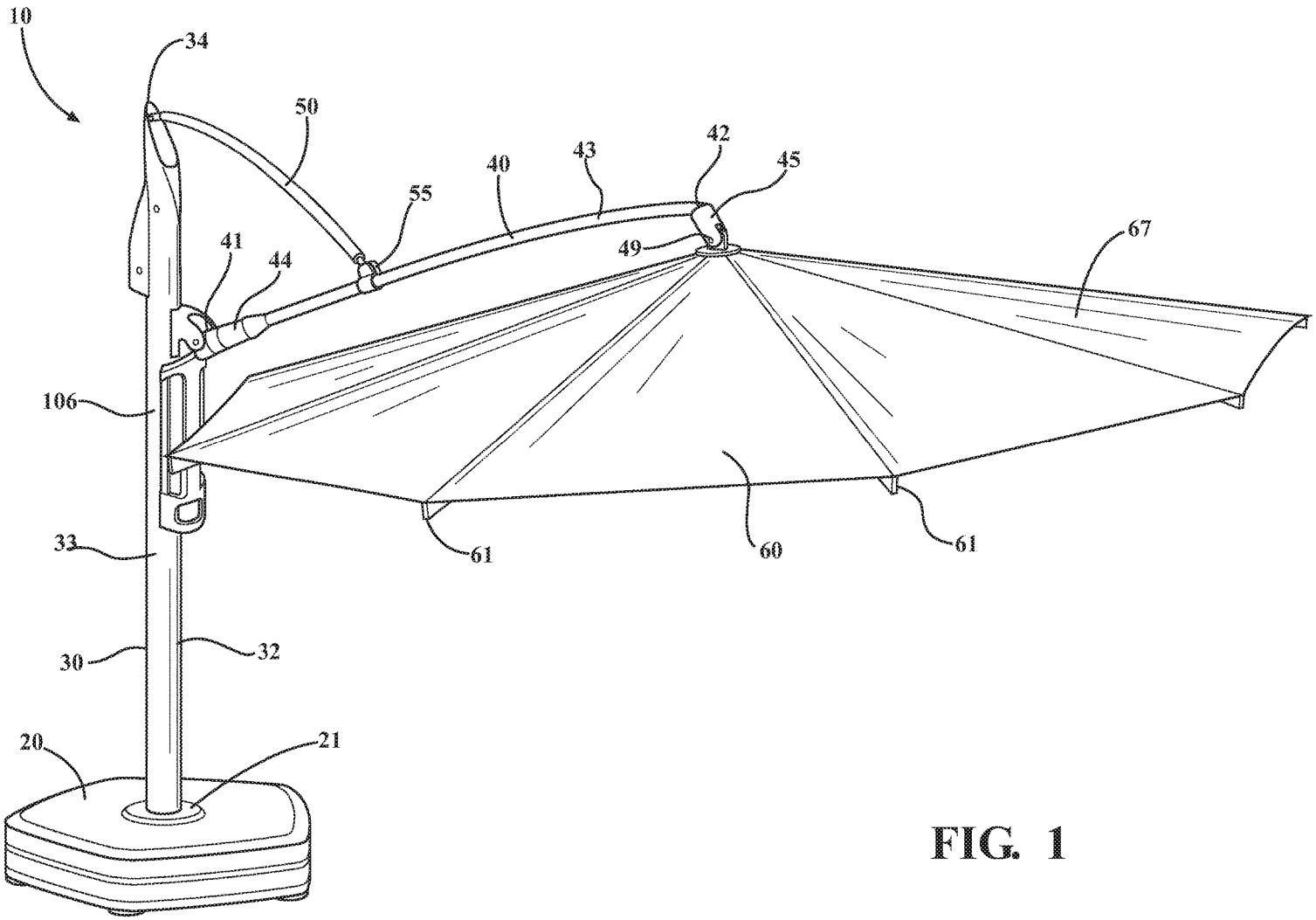
FIG. 1 is a perspective view of a cantilevered umbrella in an open position.

The disclosure herein is directed to a cantilevered umbrella 10 that uses a constant force spring 103, instead of a crank, to assist with the operation of the cantilevered umbrella 10. The constant force spring 103 can reduce the force necessary to open the cantilevered umbrella 10 to an open position while also counter balancing the weight of a cantilevered arm 40 and a canopy 60. An over-center spring assembly 150 can be provided that assists with extending the canopy 60 and holding the canopy 60 in the open position.

As illustrated in FIG. 1, the cantilevered umbrella 10 can be comprised of a base 20, a mast 30, the cantilevered arm 40, a support arm 50, and the canopy 60. The base 20 supports the cantilevered umbrella 10 and can have any configuration. In the illustrated, non-limiting example, the base 20 is hollow and has a pentagonal configuration with a collar 21 that surrounds the mast 30 where the mast 30 extends from the base 20. Examples of other configurations include triangular, rectangular, and hexagonal, among others. Alternatively, the base 20 could be solid or substantially solid. If the base 20 is hollow, the base 20 can include an opening or door (not shown) that allows a user to fill the base 20 with sand or a similar type of material to provide additional weight to counter balance the cantilevered umbrella 10.

The mast 30 can have an elongated configuration with an internal cavity 31 (shown in FIG. 2) that houses a carriage 102, the over-center spring assembly 150, and the constant force spring 103. A rail 32 can be formed on an outer surface 33 of the mast 30 to guide a guide 101 that is attached to the carriage 102. To reduce frictional loads acting on the carriage 102, the guide 101 can include ball bearings (not shown). The rail 32 can include a slot 36 (shown in FIG. 7) that extends the length of the rail 32 either in the center or on the side of the rail 32. In the illustrated, non-limiting example, the slot 36 is on the center of the rail 32, and the rail 32 extends approximately 75 percent of the length of the mast 30 from the collar 21 of the base 20. It is anticipated that the rail 32 could be shorter or longer, such as the entire length of the mast 30. The mast 30 may have a substantially tapered upper end 34 and an extension 35 that is closer to the upper end 34 than the base 20. The extension 35 can house a portion of the over-center spring assembly 150 (shown in FIG. 2).

Figure 2:
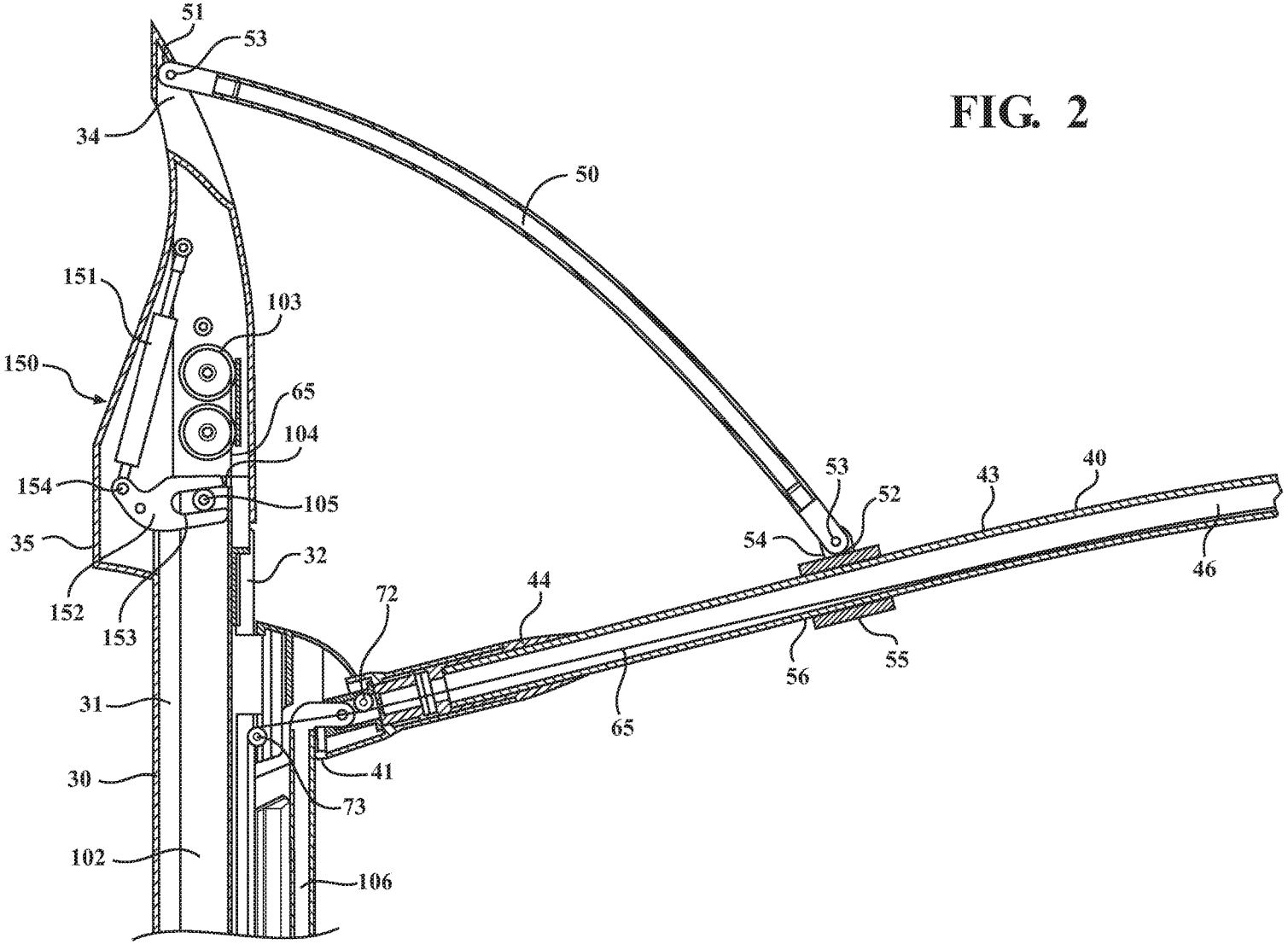
FIG. 2 is a schematic drawing of an upper portion of the cantilevered umbrella.

As shown in FIG. 2, a first end 51 of the support arm 50 is pivotally connected to the upper end 34 of the mast 30 through the use of a conventional fastener (not shown) that is capable of pivotal attachment. The support arm 50 can have an arcuate configuration with a circular cross-sectional configuration. The first end 51 and a second end 52 of the support arm 50 can have a substantially rectangular cross-sectional configuration with rounded ends and an aperture 53 extending therethrough. The support arm 50 can be solid or hollow. The second end 52 of the support arm 50 is pivotally connected to a flange 54 integrally formed on a sleeve 55 that surrounds an outer surface 43 of the cantilevered arm 40. The flange 54 can have rounded ends and an aperture (not shown) extending therethrough to accept a conventional fastener that pivotally attaches the second end 52 of the support arm 50 to the flange 54. A bore 56 can extend longitudinally through the sleeve 55 and have a large enough diameter that the cantilevered arm 40 can extend through the bore 56 and rotate within the sleeve 55, which allows the cantilevered arm 40 to be rotatably connected to the support arm 50.

The cantilevered arm 40 can be straight or have a slight bend as it extends longitudinally from a first end 41 to a second end 42. The first end 41 of the cantilevered arm 40 can include a knuckle 44 that is pivotally connected to the guide 101. The second end 42 of the cantilevered arm 40 can include an extension 45 that is pivotally connected to the canopy 60 (shown in FIG. 1). The cantilevered arm 40, including the knuckle 44 and the extension 45, has a hollow portion 46 that allows a canopy cable 65 to pass freely through the cantilevered arm 40 to the mast 30.

Figure 3:
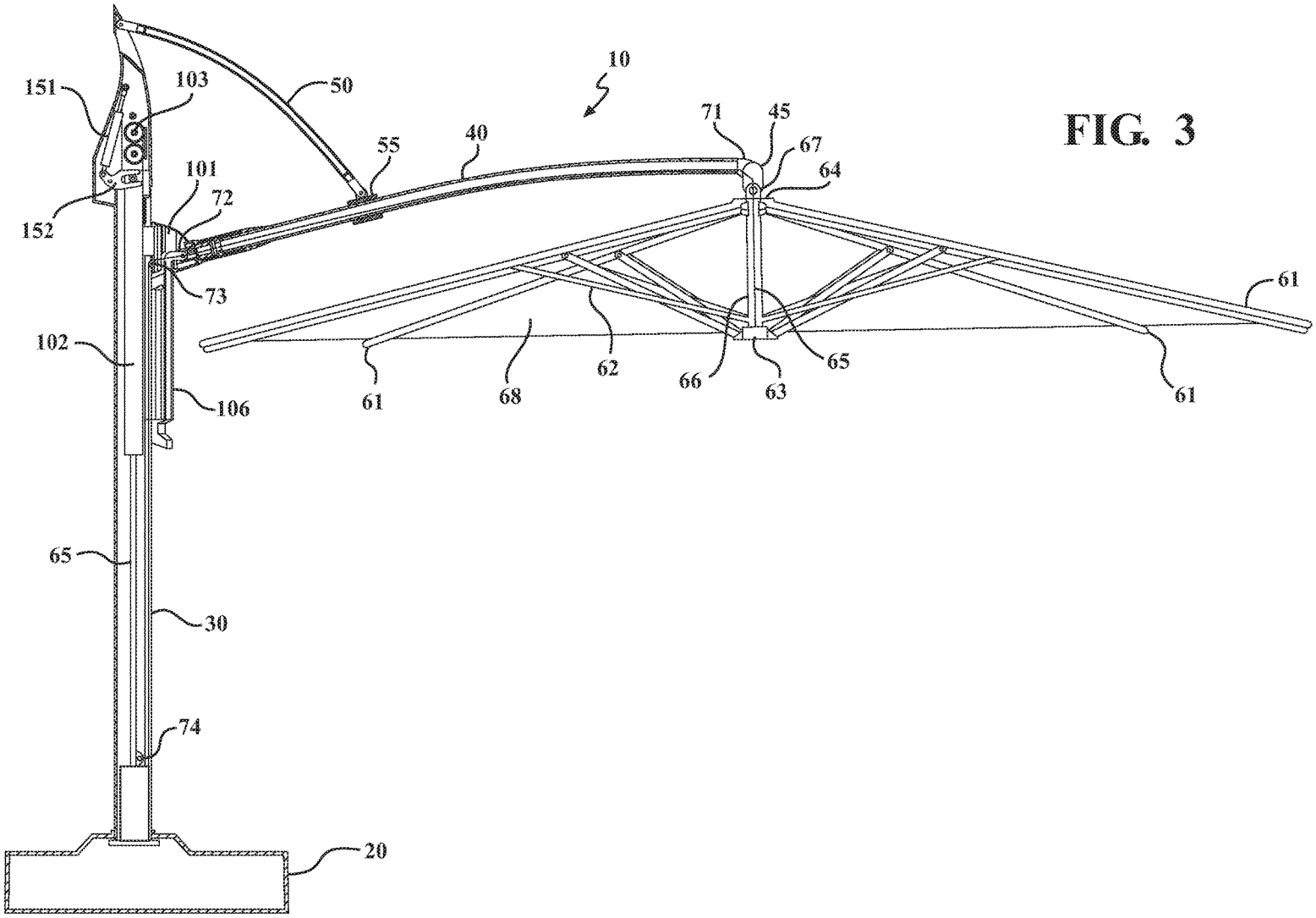
FIG. 3 is a schematic drawing of a first embodiment of the cantilevered umbrella.

As illustrated in FIG. 3, the canopy 60 can be comprised of a plurality of upper ribs 61, a plurality of lower ribs 62, a lower cap 63, an upper cap 64, the canopy cable 65, a center support 66, and a covering 68. Other canopy 60 configurations are possible. In the illustrated, non-limiting example, the upper ribs 61 are longer than the lower ribs 62, and the same number of upper ribs 61 and lower ribs 62 are provided. The upper ribs 61 and the lower ribs 62 can have any cross-sectional configuration, such as substantially circular or substantially rectangular. One end of each upper rib 61 can be pivotally connected to the upper cap 64, while the other end of each upper rib 61 can be free. One end of each lower rib 62 can be pivotally connected to a corresponding upper rib 61, and the other end of each lower rib 62 can be pivotally connected to the lower cap 63. The lower cap 63 is attached to one end of the center support 66, and the upper cap 64 is attached to the other end of the center support 66. The center support 66 can have any cross-sectional configuration, such as substantially circular or substantially rectangular. The center support 66 can be telescopic and have a hollow portion 67 that allows the canopy cable 65 to pass from the lower cap 63, where one end of the canopy cable 65 is attached, to the hollow portion 46 of the cantilevered arm 40. The covering 68, made from any suitable material such as cloth or plastic, is attached to or suspended from the upper ribs 61 to provide shade coverage or some rain protection.

The canopy 60 is moveable between the open position and a collapsed position. In the open position, shown in FIG. 1, the upper ribs 61 are extended generally horizontal, and the center support 66 is in its shortest length if the center support 66 is telescoping. In the collapsed position, shown in FIG. 11, the upper ribs 61 are extended generally vertical, and the center support 66 is in its longest length if the center support 66 is telescoping. Pulling and loosening the canopy cable 65 moves the canopy 60 between the open position and the collapsed position.

As shown in FIG. 3, the canopy cable 65 extends through the mast 30, the cantilevered arm 40, and the center support 66. One end of the canopy cable 65 is connected to a point 74 within the internal cavity 31 of the mast 30 near the base 20, and the other end is connected to the lower cap 63 of the canopy 60. To assist with the transition of the canopy cable 65 between the canopy 60 and the cantilevered arm 40, a first pulley 71 can be included within the hollow portion 46 of the extension 45. A second pulley 72 can be included in the knuckle 44 of the cantilevered arm 40. From the second pulley 72, the canopy cable 65 enters the mast 30 via the slot 36 on the rail 32 of the mast 30. A third pulley 73 can be included on the carriage 102 inside the internal cavity 31 of the mast 30 to assist with the transition of the canopy cable 65 from the cantilevered arm 40 into the mast 30.

The constant force spring 103 counterbalances the weight of the cantilevered arm 40 and the canopy 60. One end of the constant force spring 103 is attached or connected to a second end 104 of the carriage 102, and the other end of the constant force spring 103 is attached or connected to the mast 30 within the internal cavity 31. In the illustrated, non-limiting example, the other end of constant force spring 103 is attached or connected near the upper end 34 of the mast 30 within the internal cavity 31. Because the carriage 102 is moveable within the internal cavity 31 of the mast 30, the constant force spring 103 uncoils or extends as the carriage 102 is lowered and recoils or retracts as the carriage 102 is raised within the internal cavity 31 of the mast 30. Lowering of the carriage 102 results in the canopy 60 being moved to the collapsed position, and raising of the carriage 102 results in the canopy 60 being moved to the open position. Because the cantilevered arm 40 is pivotally connected to the guide 101 on the carriage 102, the lowering of the carriage 102 moves the cantilevered arm 40 to a vertical position, and the raising of the carriage 102 moves the cantilevered arm to a horizontal position.

The over-center spring assembly 150 with a gas spring 151 and a forked lever arm 152 can be provided within the internal cavity 31 of the mast 30. In the illustrated, non-limiting example, the over-center spring assembly 150 is provided within the extension 35 of the mast 30, best seen in FIG. 2. One end of the gas spring 151 can be attached to the mast 30 above the constant force spring 103, and the other end of the gas spring 151 is pivotally connected to the forked lever arm 152 below the constant force spring 103. The forked lever arm 152 has a recess 153 and an aperture 154 that allows the forked lever arm 152 to be pivotally connected to the gas spring 151. The recess 153 on the forked lever arm 152 is sized so that it can be engaged by a roller 105 extending from the second end 104 of the carriage 102 as the carriage 102 is raised within the internal cavity 31 of the mast 30.

Figure 5:
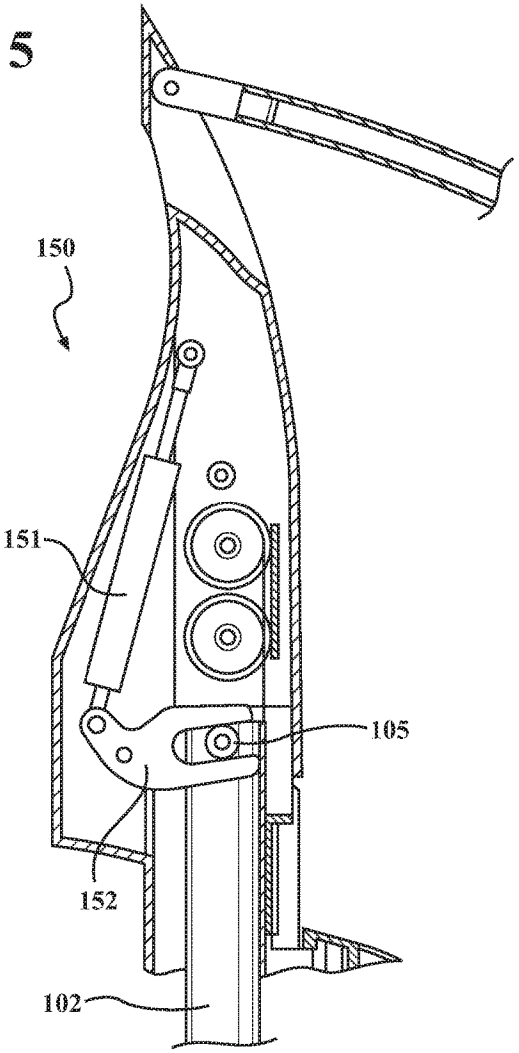
FIG. 5 is a schematic drawing of an over-center spring assembly of the cantilevered umbrella in a second position.
Figure 4:
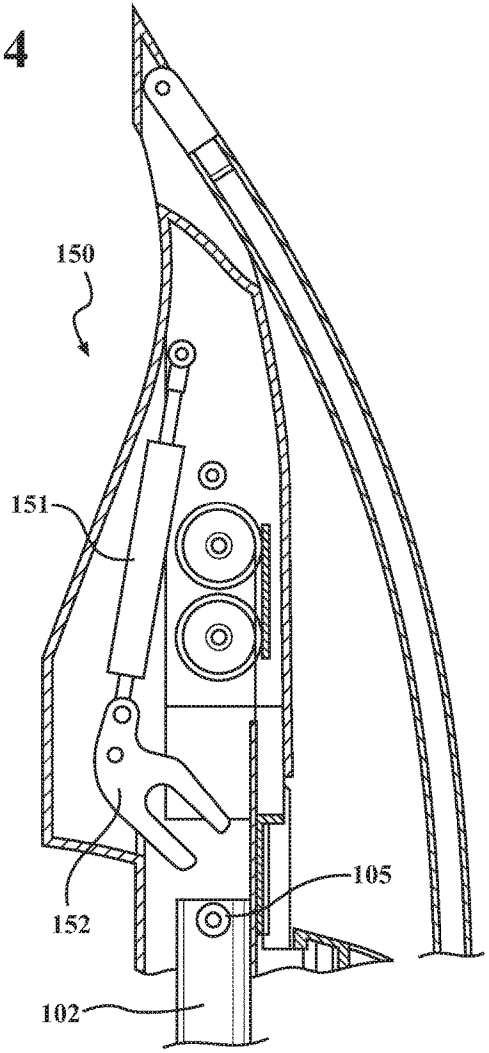
FIG. 4 is a schematic drawing of an over-center spring assembly of the cantilevered umbrella in a first position.

To assist with opening the canopy 60 and holding the canopy 60 in the open position, the over-center spring assembly 150 is moveable between a first position, shown in FIG. 4, and a second position, shown in FIG. 5. In the first position, the gas spring 151 holds the forked lever arm 152 so that the recess 153 of the forked lever arm 152 is angled slightly downward and is able to accept the roller 105 on the carriage 102. In the second position, the gas spring 151 holds the forked lever arm 152 so that the recess 153 of the forked lever arm 152 is angled substantially horizontal to retain the roller 105 on the carriage 102.

Because of the line of rotation of the forked lever arm 152 and the gas spring 151, the forked lever arm 152 will mechanically want to rest in either the first position or the second position. For example, if the forked lever arm 152 is in the first position and is moved away from the first position by the roller 105 on the carriage 102, the forked lever arm 152 will be forced back into the first position by the gas spring 151 unless enough force is applied by the roller 105 of the carriage 102 to move the forked lever arm 152 at least halfway toward the second position. Once enough force has been applied by the roller 105 of the carriage 102 to move the forked lever arm 152 past the halfway point, the force of the gas spring 151 will assist in moving the forked lever arm 152 into the second position. The same scenario is true for moving from the second position into the first position.

Figure 6:
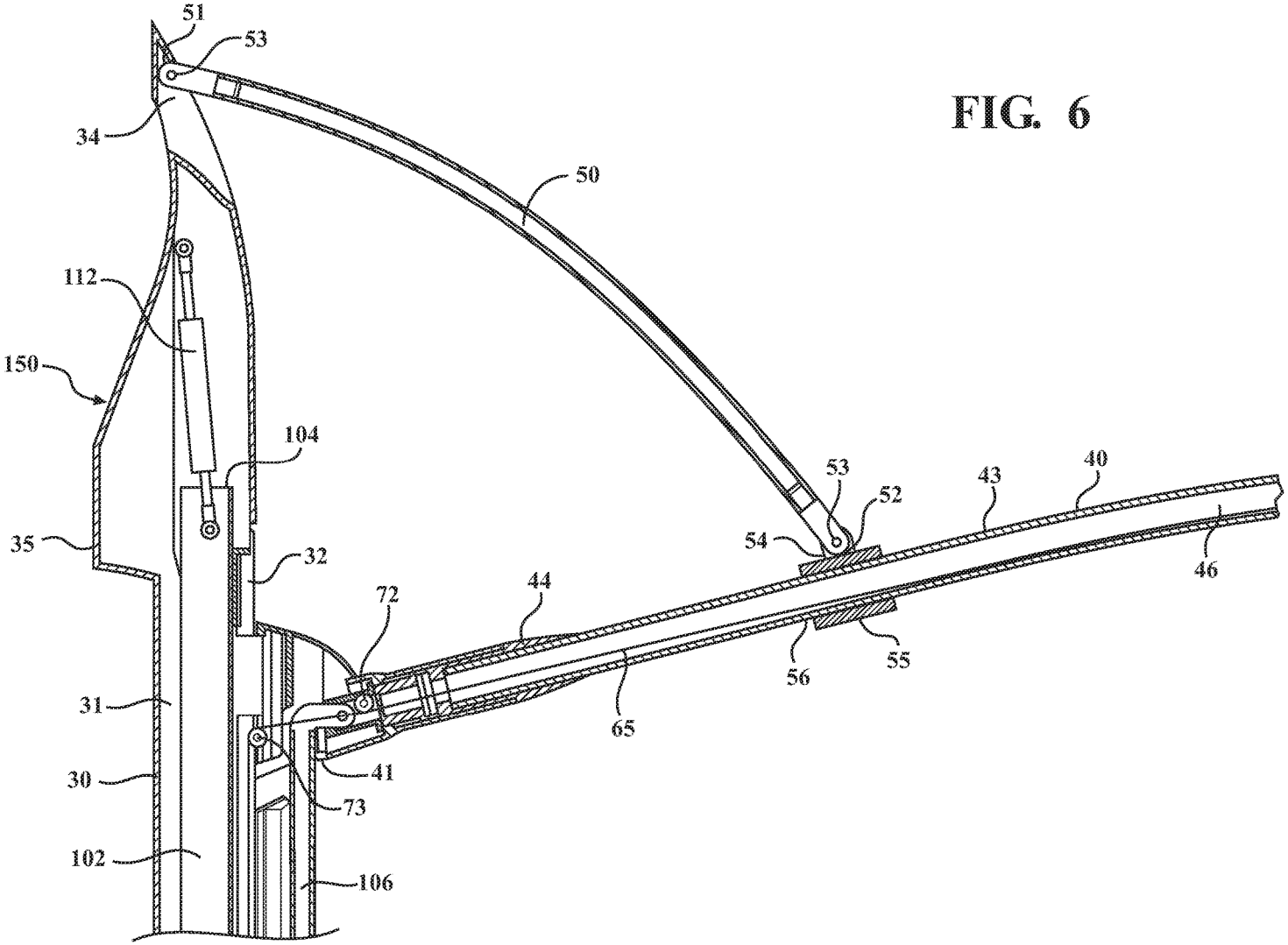
FIG. 6 is a schematic drawing of a second embodiment of the cantilevered umbrella.

In a second embodiment of the cantilevered umbrella (10), the over-center spring assembly 150 is omitted, which is illustrated in FIG. 6. The constant force spring 103 is replaced with a gas spring 112 that is connected to the mast 30 and the carriage 102. For all other intents and purposes, the first and second embodiments of the cantilevered umbrella (10) are the same and interchangeable. In other words, the gas spring 112 could be used with the over-center spring assembly 150 as described in relation to the first embodiment, and the over-center spring assembly 150 could be omitted when the constant force spring 103 is used instead of the gas spring 112. Any reference to the constant force spring 103 in this disclosure applies to the gas spring 112 as well.

Figure 7:
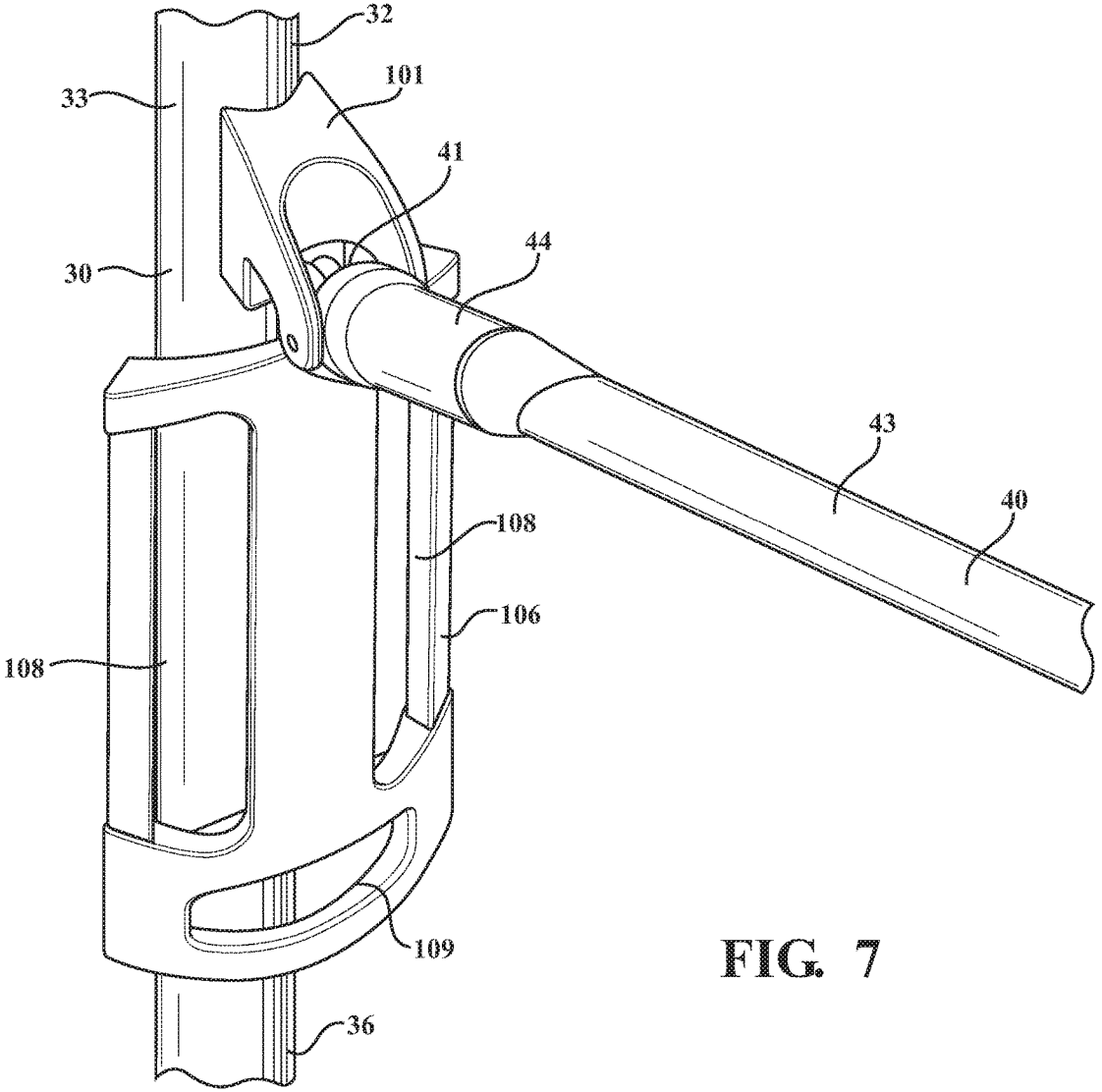
FIG. 7 is a perspective view of a handle of the cantilevered umbrella.
Figure 8:
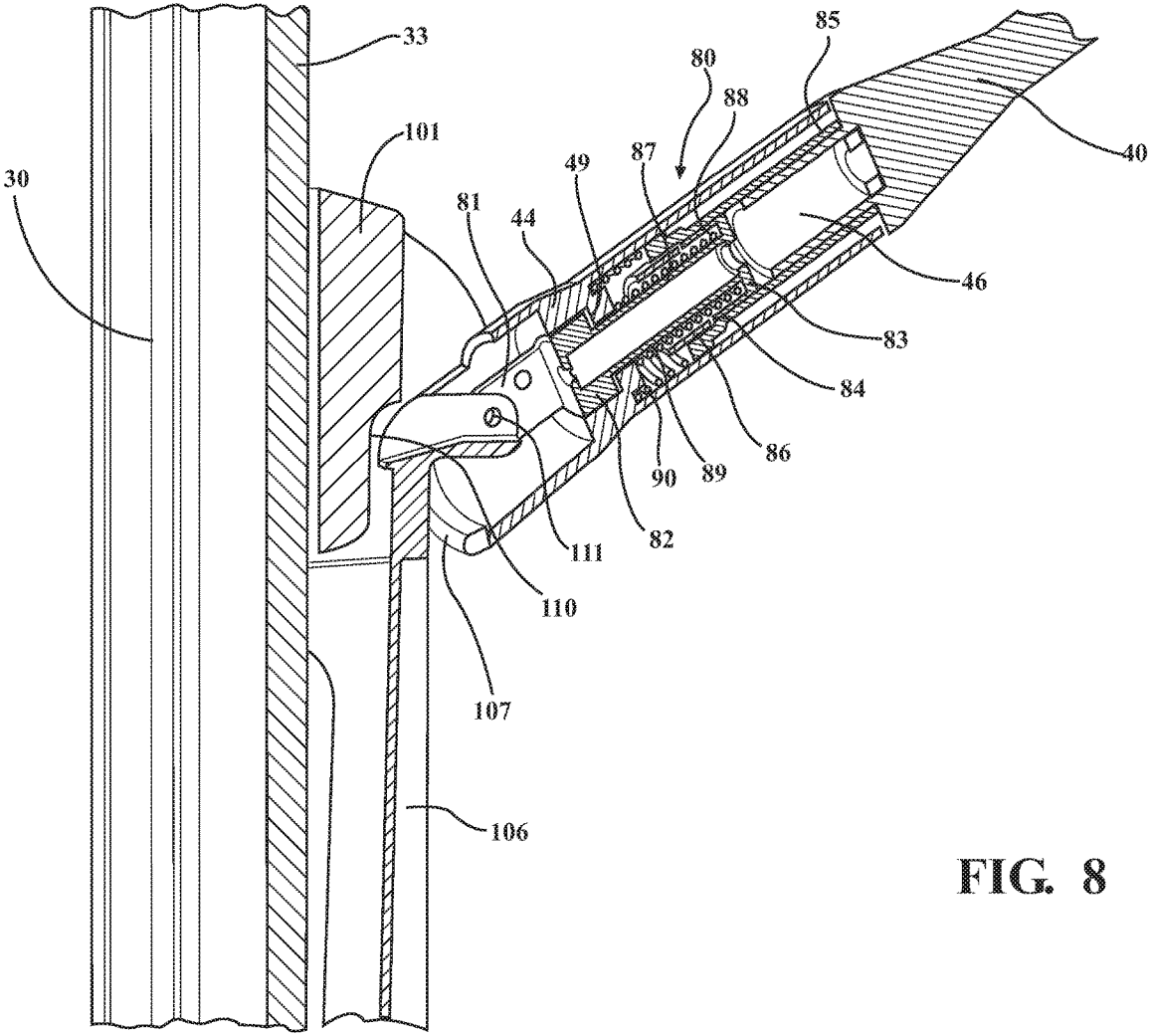
FIG. 8 is a perspective, cross-sectional view of a first embodiment of a tilting assembly of the cantilevered umbrella.

To allow pivotal rotation of the cantilevered arm 40 and the canopy 60, a tilting assembly is provided within the knuckle 44 of the cantilevered arm 40 that is activated by a handle 106 with a lever 107. As seen in FIGS. 7-8, the handle 106 extends longitudinally along the mast 30 and can be provided with a plurality of apertures 108, 109 that can be used as handgrips. In the illustrated, non-limiting example, there are two substantially similar apertures 108 along the right and left sides of the handle 106, which allow the handle 106 to be operated from either side of the cantilevered umbrella 10. A third aperture 109 is along the bottom of the handle 106. The handle 106 can have an arcuate cross-sectional configuration that bends slightly around the mast 30. The underside of the handle 106 can also include a protrusion or similar feature (not shown) that allows the handle 106 to be secured to the carriage 102 with a conventional fastener (now shown), such as a bolt. The lever 107 extends from an upper region of the handle 106 and has a flange 110 extending substantially perpendicular to the handle 106. A free end of the flange 110 has an aperture 111 extending therethrough.

According to a first embodiment 80 of the tilting assembly, the lever 107 is pivotally connected to a plunger 81 through the use of a conventional fastener (not shown). The plunger 81 is elongated and extends through the hollow portion 46 of the knuckle 44. The plunger 81 has a hollow portion to allow passage of the canopy cable 65 (not shown in FIGS. 7-8) and includes a first shoulder 82 that is complementary to a first shoulder 49 formed in the knuckle 44. When the handle 106 is substantially vertical, a slight gap is formed between the first shoulder 82 of the plunger 81 and the first shoulder 49 of the knuckle 44. The end opposite the lever 107 provides a face plate 83 with a contoured surface 84. The face plate 83 surrounds the plunger 81 and forms a second shoulder 88 for a first spring 89 that surrounds the plunger 81. The other end of the first spring 89 engages a second shoulder 59 formed in the knuckle 44. An outer circumference of the face plate 83 extends toward the mast 30, and the contoured surface 84 is provided on the end of the face plate 83 that faces the mast 30.

A joint 85 is connected to the cantilevered arm 40 such that rotation of the joint translates into rotation of the cantilevered arm 40 and the canopy 60. The joint 85 having a substantially tubular configuration is housed within the knuckle 44 adjacent to a second spring 90. The joint 85 includes an internal face plate 86 having a contoured surface 87 that faces away from the mast 30. The contoured surface 87 of the joint 85 is engageable with the contoured surface 84 of the plunger 81. When the handle 106 is substantially vertical, a slight gap is formed between the contoured surface 87 of the joint 85 and the contoured surface 84 of the plunger 81.

Figure 9:
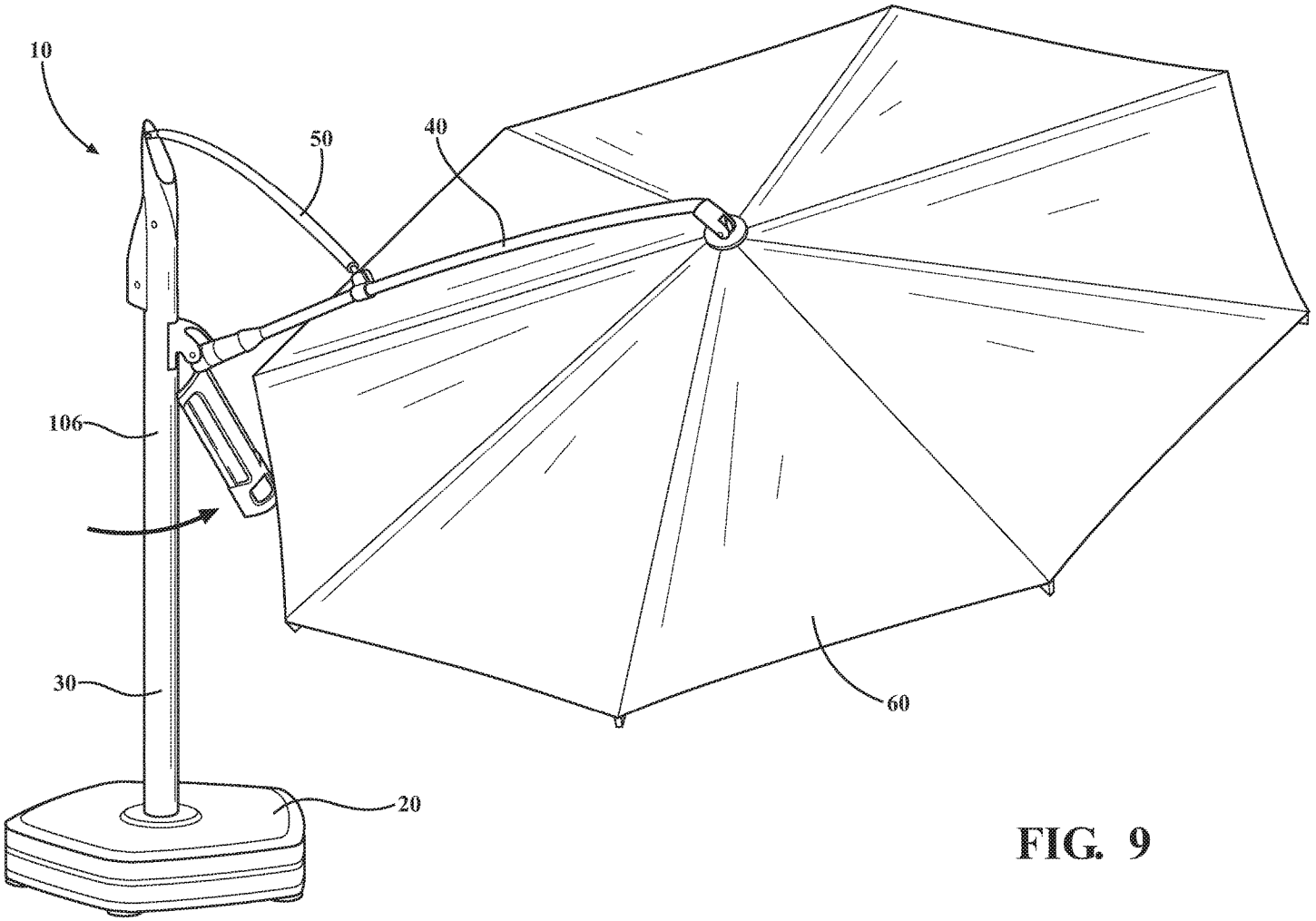
FIG. 9 is a perspective view of the cantilevered umbrella rotated in the open position.

The first embodiment 80 of the tilting assembly rotates the cantilevered umbrella 10, as shown in FIG. 9, by pivoting the bottom of the handle 106 away from the mast 30. As a result, the lever 107 on the handle 106 pulls the plunger 81 toward the mast 30 so that the contoured surface 84 of the plunger 81 engages the contoured surface 87 of the joint 85. With the contoured surfaces 84, 87 engaged, the cantilevered arm 40 will rotate along with the handle 106. Once the desired rotation of the cantilevered arm 40 and the canopy 60 is achieved, the handle 106 is returned and secured to the substantially vertical position along the mast 30. The first spring 89 will push the face plate 83 of the plunger 81 away from the face plate 86 of the joint 85. The cantilevered arm 40 and the canopy 60 will remain in the desired position.

Figure 10:
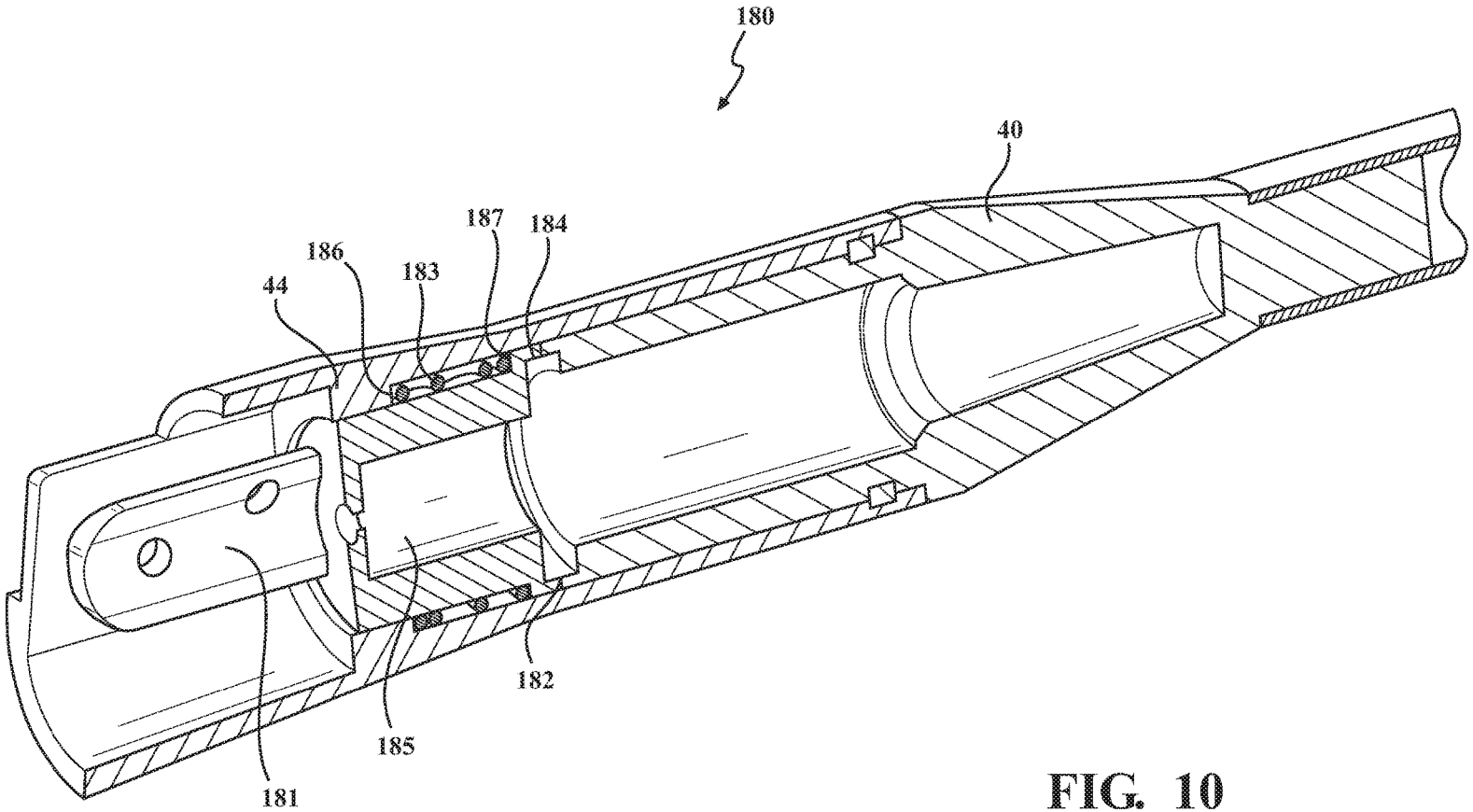
FIG. 10 is a perspective, cross-sectional view of a second embodiment of the tilting assembly of the cantilevered umbrella.

The tilting assembly is simplified in a second embodiment 180, which is shown in FIG. 10. The second embodiment 180 of the tilting assembly includes a plunger 181 with a contoured surface 182, a spring 183, and a contoured surface 184 on the cantilevered arm 40. Similar to the plunger 81 of the first embodiment 80, the plunger 181 of the second embodiment 180 is pivotally connected to the lever 107, is disposed within the knuckle 44, and has a hollow portion 185 that allows the canopy cable 65 to pass through the plunger 181. The spring 183 surrounds the plunger 181 and engages a shoulder 186 formed in the knuckle 44 and a shoulder 187 formed on the plunger 181. The contoured surface 182 on the plunger 181 faces away from the mast 30. The contoured surface 184 on the cantilevered arm 40 faces toward the mast 30.

Similar to the first embodiment 80 of the tilting assembly, the cantilevered umbrella 10 is rotated by pivoting the bottom of the handle 106 away from the mast 30. As a result, the lever 107 on the handle 106 pulls the plunger 181 away from the mast 30 so that the contoured surface 182 of the plunger 181 is pulled away from the contoured surface 184 of the cantilevered arm. With the contoured surfaces 182, 184 disengaged, the cantilevered arm 40 is free to rotate with the handle 106. Once the desired rotation of the cantilevered arm 40 and the canopy 60 is achieved, the handle 106 is returned and secured to the substantially vertical position along the mast 30. The spring 183 will push the contoured surface 182 of the plunger 181 toward the contoured surface 184 of the cantilevered arm 40.

Figure 11:
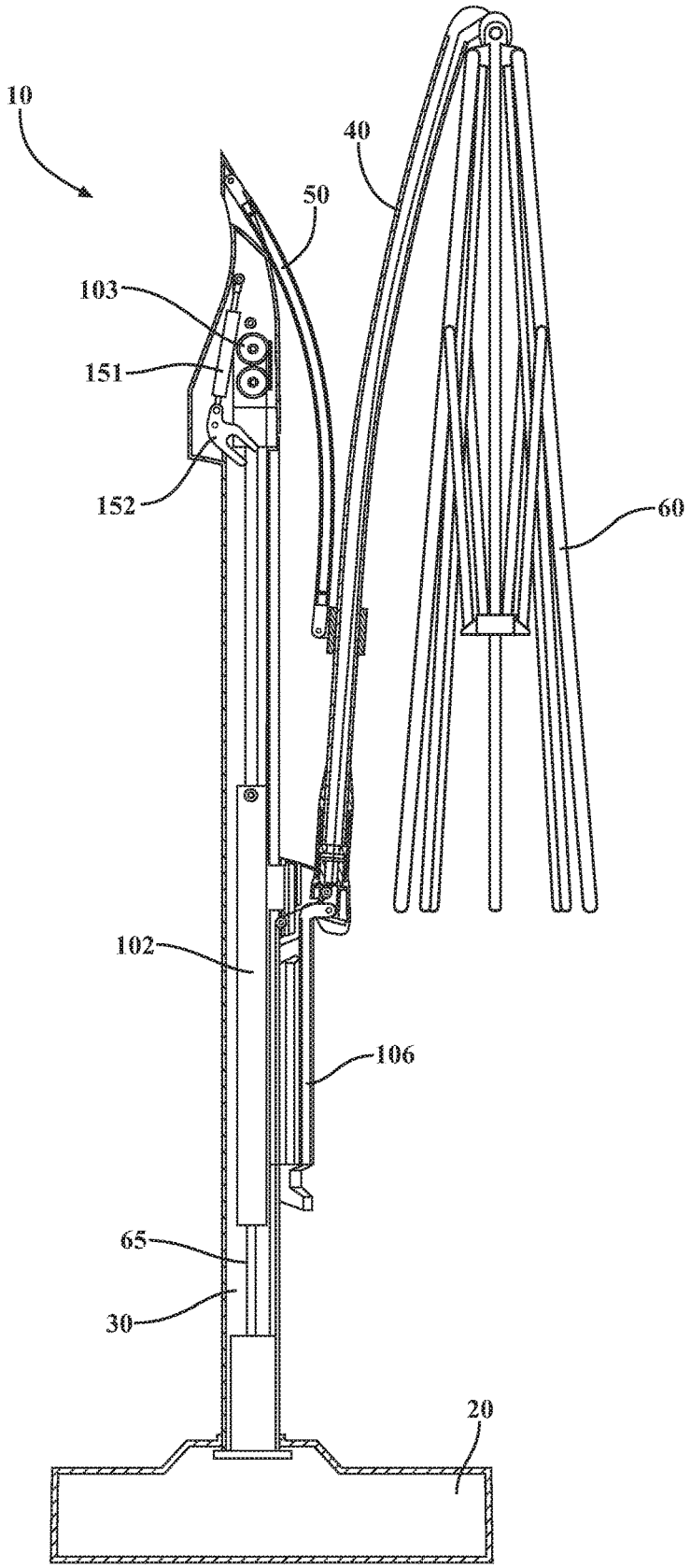
FIG. 11 is a schematic drawing of the cantilevered umbrella in a collapsed position.

To open the cantilevered umbrella 10 from the collapsed position shown in FIG. 11, the handle 106 is pushed toward the upper end 34 of the mast 30 with the guide 101 guided along the rail 32 on the mast 30. Because of the constant force spring 103 and the over-center spring assembly 150, the carriage 102 raises within the internal cavity 31 of the mast 30 in an essentially effortless operation. As the carriage 102 rises, the constant force spring 103 recoils, the cantilevered arm 40 moves to the substantially horizontal position, and the lower cap 63 of the canopy 60 is brought closer to the upper cap 64 by the canopy cable 65, which opens the canopy 60. As the carriage 102 approaches the over-center spring assembly 150, the roller 105 on the carriage 102 will engage the recess 153 on the forked lever arm 152 without input from the user. The forked lever arm 152 is pushed upward by the roller 105 on the carriage 102. Once the forked lever arm 152 is pushed at least halfway from the first position to the second position, the over-center spring assembly will provide additional force to fully extend the canopy 60 and hold the canopy 60 in the open position. Once fully extended, the cantilevered umbrella 10 can be rotated as previously described depending the embodiment of the tilting assembly that is present.

To return the cantilevered umbrella 10 to the collapsed position, the handle 106 is pushed toward the base 20 with the guide 101 guided along the rail 32 on the mast 30. As the carriage 102 lowers within the internal cavity 31 of the mast 30, the constant force spring 103 uncoils, the cantilevered arm 40 moves to the substantially vertical position, and the lower cap 63 of the canopy 60 is moved away from the upper cap 64 by the canopy cable 65, which collapses or closes the canopy 60. When the roller 105 on the carriage 102 disengages the recess 153 on the forked lever arm 152, the over-center spring assembly 150 holds the forked lever arm 152 is the second position, which allows the forked lever arm 152 to be ready to accept the roller 105 on the carriage 102 the next time the cantilevered umbrella 10 is moved to the open position.

While the invention has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A cantilevered umbrella (10) comprising:

a mast (30) extending substantially vertical;

a cantilevered arm (40) extending from the mast (30);

a canopy (60) extending from the cantilevered arm (40), wherein the canopy (60) is moveable between an open position, wherein the canopy (60) is extended, and a collapsed position, wherein the canopy (60) is collapsed;

a carriage (102) connected to the cantilevered arm (40) and vertically moveable along the mast (30) to move the canopy (60) between the open position and the collapsed position;

at least one of a constant force spring (103) or a gas spring (112) is connected to the mast (30), wherein the at least one of the constant force spring (103) or the gas spring (112) is operable with the carriage (102) to assist with moving the canopy (60) between the open position and the collapsed position and to counterbalance the weight of the cantilevered arm (40) and the canopy (60); and an over-center spring assembly (150) disposed within an internal cavity (31) of the mast (30) and having a gas spring (151) and a forked lever arm (152), wherein the forked lever arm (152) is pivotally connected to the gas spring (151) and engages a roller (105) of the carriage (102) when the canopy (60) is in the open position.

2. The cantilevered umbrella (10) of claim 1, wherein a recess (153) of the forked lever arm (152) engages the roller (105) of the carriage (102) when the canopy (60) is in the open position.

3. The cantilevered umbrella (10) of claim 2, wherein the forked lever arm (152) is moveable between a first position, where the recess (153) of the forked lever arm (152) is angled downward, and a second position, where the recess (153) of the forked lever arm (152) is angled upward.

4. The cantilevered umbrella (10) of claim 1, wherein the at least one of the constant force spring (103) or the gas spring (112) uncoils or extends as the carriage (102) is lowered within the internal cavity (31) of the mast (30) and recoils or retracts as the carriage (102) is raised within the internal cavity (31) of the mast (30).

5. A cantilevered umbrella (10) comprising:

a mast (30) having an internal cavity (31);

a cantilevered arm (40) extending from the mast (30);

a canopy (60) extending from the cantilevered arm (40), wherein the canopy (60) is moveable between an open position, wherein the canopy (60) is extended, and a collapsed position, wherein the canopy (60) is collapsed;

a carriage (102) connected to the cantilevered arm (40) and vertically moveable along the mast (30) to move the canopy (60) between the open position and the collapsed position; and an over-center spring assembly (150) disposed within the internal cavity (31) of the mast (30) and having a gas spring (151) and a forked lever arm (152), wherein the forked lever arm (152) is pivotally connected to the gas spring (151) and engages a roller (105) of the carriage (102) when the canopy (60) is in the open position.

6. The cantilevered umbrella (10) of claim 5, wherein a recess (153) of the forked lever arm (152) engages the roller (105) of the carriage (102) when the canopy (60) is in the open position.

7. The cantilevered umbrella (10) of claim 6, wherein the forked lever arm (152) is moveable between a first position, where the recess (153) of the forked lever arm (152) is angled downward, and a second position, where the recess (153) of the forked lever arm (152) is angled upward.

8. The cantilevered umbrella (10) of claim 5, further comprising:

a rail (32) extending substantially vertically along an outer surface (33) of the mast (30); and a guide (101) connected to the rail (32) and the carriage (102), wherein the carriage (102) raises within the internal cavity (31) of the mast (30) as the guide (101) is raised along the rail (32) and the carriage (102) lowers within the internal cavity (31) of the mast (30) as the guide (101) is lowered along the rail (32).

9. The cantilevered umbrella (10) of claim 5, further comprising:

at least one of a constant force spring (103) or a gas spring (112) disposed within the internal cavity (31) of the mast (30) and operable with the carriage (102) to assist with moving the canopy (60) between the open position and the collapsed position.

10. The cantilevered umbrella (10) of claim 9, wherein the at least one of the constant force spring (103) or the gas spring (112) is connected to the mast (30) within the internal cavity (31) at a point that is closer to an upper end (34) of the mast (30) than a base (20).

11. The cantilevered umbrella (10) of claim 9, wherein the at least one of the constant force spring (103) or the gas spring (112) uncoils or extends as the carriage (102) is lowered within the internal cavity (31) of the mast (30) and recoils or retracts as the carriage (102) is lowered within the internal cavity (31) of the mast (30).

* * * * *